United States Patent [19]

Baker et al.

[11] Patent Number: 4,727,702

[45] Date of Patent: Mar. 1, 1988

[54] PANEL USEFUL FOR GATES OR FENCE SECTIONS

[75] Inventors: Kathleen T. Baker, 4381 Bodega Ave., Petaluma, Calif. 94952; David E. Baker, Rohnert Park, Calif.

[73] Assignee: Kathleen T. Baker, Petaluma, Calif.

[21] Appl. No.: 926,899

[22] Filed: Nov. 3, 1986

[51] Int. Cl.[4] ..... E04B 1/343; E06B 3/22

[52] U.S. Cl. ..... 52/656; 135/101; 49/381

[58] Field of Search ..... 52/656–658, 52/664, 727, 106; 109/29; 135/DIG. 1, 101, 102; 49/55, 85, 381

[56] References Cited

U.S. PATENT DOCUMENTS

| | | | |
|---|---|---|---|
| 162,203 | 4/1875 | Southward | 52/657 |
| 2,598,940 | 6/1952 | Robie | 135/DIG. 1 |
| 2,798,501 | 7/1957 | Oliver | 135/DIG. 1 |
| 2,963,273 | 12/1960 | Lane | 52/223 R |
| 3,498,654 | 3/1970 | Diaz et al. | 52/656 |
| 3,507,229 | 4/1970 | MacDonald | 109/29 |
| 3,554,494 | 1/1971 | Bee | 256/19 |
| 3,957,250 | 5/1976 | Murphy | 256/19 |
| 4,053,140 | 10/1977 | Clemens et al. | 256/19 |
| 4,465,262 | 8/1984 | Riley et al. | 49/85 |
| 4,477,059 | 10/1984 | Willis | 256/65 |
| 4,516,756 | 5/1985 | Beatty | 256/19 |
| 4,553,741 | 11/1985 | Creasy et al. | 256/66 |

FOREIGN PATENT DOCUMENTS

| | | | |
|---|---|---|---|
| 5130 | 2/1912 | United Kingdom | 52/727 |
| 2036912 | 7/1980 | United Kingdom | 52/656 |

*Primary Examiner*—James L. Ridgill, Jr.

*Attorney, Agent, or Firm*—Majestic, Gallagher, Parsons & Siebert

[57] ABSTRACT

A lightweight panel is provided that may be used as a gate, a fence section, or the base of a temporary carport. The panel may be selectively made more massive, and includes a peripheral structure comprised of hollow plastic extrusions having corresponding solid extrusions disposed therein while leaving sufficient space to permit a liquid to be interposed within the hollow plastic extrusions when desired.

10 Claims, 4 Drawing Figures

PANEL USEFUL FOR GATES OR FENCE SECTIONS

FIELD OF THE INVENTION

The present invention relates to a building component, or panel, useful as a gate, a portable carport, assembled as a fence, or the like. The panelis lightweight, and may be selectively made more massive by introducing water into a peripheral chamber.

BACKGROUND OF THE INVENTION

Animal husbandry involves controlling the movements of livestock. Driveways often must have a gate to prevent the livestock (such as sheep, goats, pigs or calves) from entering into areas reserved for human use or into gardens. Such gates have typically been made of wood or aluminum. Large, wooden gates are quite heavy and difficult repeatedly to open and close, especially for smaller or less strong persons. Aluminum gates, while lighter in weight, tend to bend, particularly when pushed by livestock, and often have rough edges which pose a hazard to animals and humans.

Similarly in animal husbandry, there is often a need for temporary animal pens for livestock. Wooden structures are usually too heavy to be readily portable.

It has been known to cover wooden or steel building components, such as posts and rails, with sheaths of hollow plastic. For example, U.S. Pat. No. 4,516,756, issued May 14, 1985, inventor Beatty, discloses a fence post encased in a rigid hollow polyvinyl chloride sheath. U.S. Pat. No. 3,554,494, issued Jan. 12, 1971, inventor Bee, discloses a fence structure of hard polyvinyl chloride having its interior divided into a plurality of channels into which is slidingly fit timber or steel. However, these prior known posts and fences are relatively massive, permanent structures and do not solve the need for smooth, lightweight and portable building components.

U.S. Pat. No. 4,477,059, issued Oct. 16, 1984, inventor Willis, discloses a fence formed of hollow fiberglass posts and rails. Although apparently lightweight, the fence is intended to be permanently set by posts into the ground, has no permanent internal reinforcing, and has no means of selectively reinforcing, or making more massive, as may be occasionally needed.

SUMMARY OF THE INVENTION

The present invention is directed to overcoming one or more of the problems as set forth above.

In one aspect of this invention a panel, useful or adaptable as a gate, fence section or building component such as a carport, comprises a peripheral structure having at least one hollow plastic extrusion and at least one solid extrusion corresponding to the hollow plastic extrusion. The corresponding solid extrusion is disposed within the hollow plastic extrusion while leaving sufficient space to permit a liquid to be interposed in the hollow plastic extrusion. The panel also includes means for selectively permitting a liquid to be interposed into the hollow plastic extrusion adjacent the corresponding solid extrusion.

A rectangle is a preferred form for the peripheral structure when used as a gate or fence section, with the hollow plastic extrusion preferably being tubular and the solid extrusion preferably being cylindrical. Where the panel is intended for use as a gate, fence section or animal pen, then a plurality of crossbars preferably extend across the region bounded by the peripheral structure and are attached thereto.

Several such panels may be assembled together (with vertical edges fastened one to another) for a lightweight, temporary animal pen. If desired, a liquid such as water can be flowed into the hollow plastic extrusions to make the panel more massive, and thus more resistant against an animal's push. When the water is drained, then the panel is again readily relocated.

DETAILED DESCRIPTION OF PREFERRED EMBODIMENTS

Figure 1:
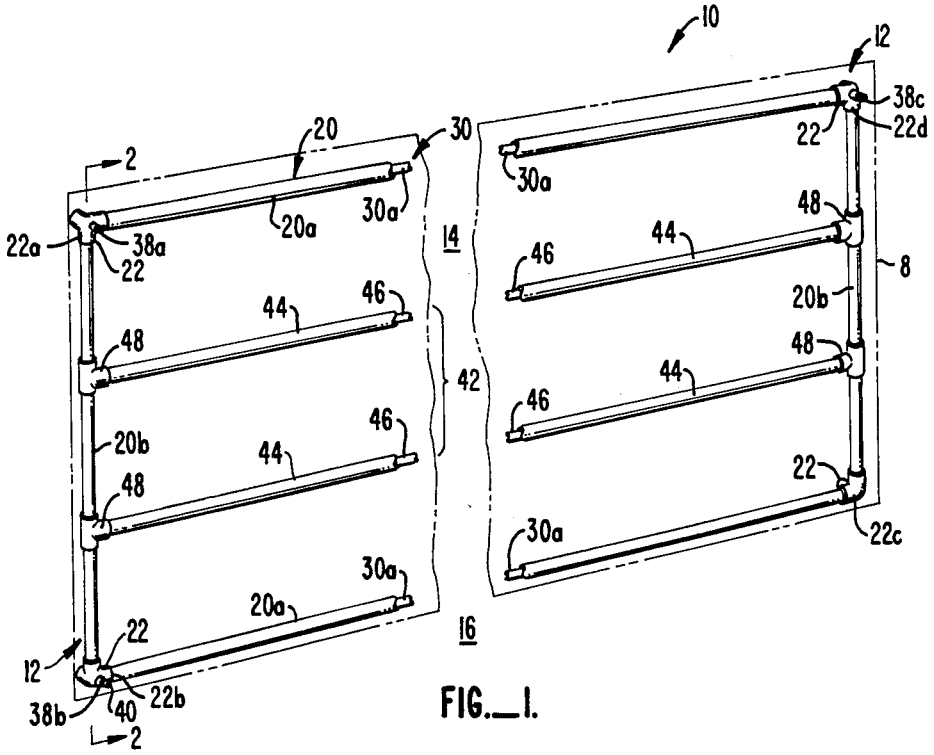
FIG. 1 is a perspective view of an embodiment of the invention.

Broadly, and referring to FIG. 1, the present invention is a panel 10 which may be used as a gate, fence section or building component. When using panel 10 as a fence section, then a plurality of such panels may be assembled in the desired configuration. For example, if a temporary animal pen is desired, then four of these panels may be erected, each perpendicular to and adjacent to two others to form a square, and the corners fastened or lashed together by any suitable fastening means, such a bungee cord. Such a pen assembly (not illustrated) is particularly suitable for small livestock such as sheep.

Panel 10 comprises a peripheral structure 12 which preferably forms a quadrilateral, more preferably a rectangle. Peripheral structure 12 defines an internal region 14 and an external region 16. Internal region 14 may be viewed as the plane passing through and bounded by, or within, the peripheral structure 12. External region 16 may be viewed as the space outside of peripheral structure 12 and not including internal region 14.

Peripheral structure 12 has at least one hollow plastic extrusion 20, and in a quadrilateral form has a first opposed pair **20*a* of hollow plastic extrusions and a second opposed pair 20*b* of opposed hollow plastic extrusions, with each hollow plastic extrusion of one pair being connected by connecting means 22** to both hollow plastic extrusions of the other pair.

As will be understood, the number of plastic extrusions 20 will usually depend upon the particular geometric form desired. For example, a quadrilateral form will typically have four plastic extrusions, while a circular form would usually have one, and a triangular form would usually have three.

Each hollow plastic extrusion 20 has a corresponding solid extrusion 30. The corresponding solid extrusion 30 is disposed within the hollow plastic extrusion 20 while leaving sufficient space, that is a chamber, to permit a liquid to be interposed in the hollow plastic extrusion 20. The correspondence is such that there is, for example, a pair **30*a* of solid extrusions disposed within the first pair 20*a* of plastic extrusions and another pair 30*b* within the second pair 20*b*** of plastic extrusions in the preferred, rectangular form.

Figure 2:
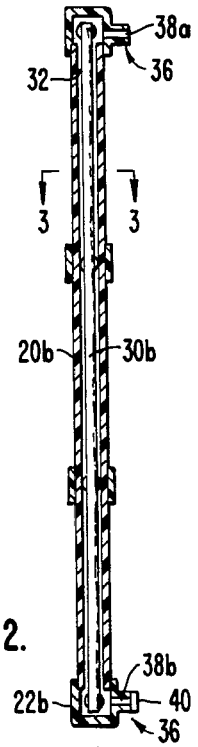
FIG. 2 is a cross-sectional view, taken along lines 2—2, of the embodiment illustrated in FIG. 1.
Figure 3:
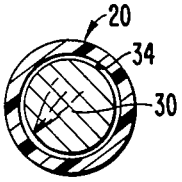
FIG. 3 is an enlarged, cross-sectional view, taken along lines 3—3.

Turning to FIGS. 2 and 3, this space, or chamber 32, is illustrated. A preferred liquid for introducing into chamber 32 is water, or more preferably an aqueous solution having a freezing point below 0° C. Suitable such aqueous solutions are water and ethylene glycol mixtures to provide portection against swelling and bursting problems when chamber 32 contains the liquid and panel 10 is exposed to freezing or sub-freezing temperatures.

It is preferred that the plastic extrusion(s) 20 be tubular, and the solid extrusion(s) be cylindrical, or rod-like. As illustrated by clearance 34 in FIG. 3, the hollow plastic extrusions 20 preferably have a cross-sectional internal dimension that is at least about one-eighth (⅛) inch larger than the cross-sectional, external dimension of the corresponding solid extrusion 30 in order to permit introduction of sufficient water to create a distinct difference in weight between the panel with and without water. For example, a panel having overall dimensions of 5 feet × 10 feet and with crossbraces can weigh on the order of about 48 pounds without water, and can easily gain 12 pounds or more by introducing water.

The hollow plastic extrusions 20 are preferably made of a relatively lightweight plastic such as polyvinyl chloride, while the solid extrusions 30 are preferably wooden rods or dowels. The preferred combination of polyvinyl chloride tubes and wooden dowel reinforcing rods has been found to be suitable for movable livestock panels as a temporary livestock restraint with sheep and as a permanent driveway gate. When solid extrusions 30 are wooden rods or dowels, they may be pretreated with a preservative and/or a compound having a freezing point below 0° C. For example, wooden solid extrusions 30 are preferably impregnated with ethylene glycol before assembly of panel 10 to assist in preventing freezing when chamber 32 contains an aqueous solution in freezing conditions.

As illustrated by FIG. 2, the panel 10 includes means 36 for permitting a liquid, such as water, to be interposed into the hollow plastic extrusion 20 adjacent the corresponding solid extrusion 30. Means 36 preferably permits the liquid to be selectively interposed into and drained out of chamber 32 and extends around at least a portion of peripheral structure 12. Means 36 preferably includes at least two transverse passageways 38 interconnecting the external region 16 with chamber 32.

Referring to FIG. 1, there may be three such passageways 38 illustrated as 38*a*, 38*b* and 38*c*. Upper passageway 38*a* may be used to introduce water into panel 10 when lower passageway 38*b* is closed by any conventional closure 40. Upper passageway 38*c* facilitates the filling of panel 10 around at least a portion of peripheral structure 12 with water, as passageway 38*c* permits displacing air to be vented. Three such passageways are preferred when panel 10 is used as a gate. Two such passageways (38*a* and 38*c*) are preferred when panel 10 is used a temporary fence assembly, since passageway 38*c* can have the alternate function of an air vent and later a drain.

Means 36 is selective in that the chamber 32 of panel 10 may be partially or entirely filled with liquid as the circumstances of use may require, but the liquid may then be drained by removing closure 40 at passageway 38*c* (or laying panel 10 onto the ground when there are two passageways with one having dual functions).

A garden hose, or other conventional means, may be used to introduce the liquid directly into passageway 38*a*, or via a conventional adapter. Thus, for example, when assembling a plurality of panels 10 into a livestock restraint for larger or more active animals or for longer-term use, the liquid may be utilized to make the assemblage more massive. Without water the assemblage or an individual panel 10 may be readily transported or rearranged.

Connecting means 22 is illustrated in FIG. 1 as L-shaped, hollow plastic members 22*a*, 22*b*, 22*c* and 22*d*. These are preferably also of polyvinyl chloride and may be "side-out L's" for convenience in providing the passageways 38. The L-shaped members 22 may be permanently attached to hollow plastic extrusions 20 by gluing, or may be releasably connected by appropriate screw threads.

As illustrated by FIG. 1, panel 10 preferably includes bracing means 42 within internal region of 14 for bracing the peripheral structure 12. As illustrated, means 42 may be a plurality of crossbars 44 with each crossbar 44 extending across internal region 14 and being attached to the peripheral structure 12 at the crossbar ends. Crossbars 44 preferably are analogous to the plastic extrusions 20 in being hollow, and including rods 46 within crossbars 44. Hollow plastic "T" members 48 may be used to attach crossbars 44 to peripheral structure 12 by gluing or the like. If desired, and preferred for large longitudinally extending panels, one or more crossbars (not illustrated) transverse to crossbars 44 may be utilized for further strengthening and bracing.

It is preferred that all plastic components of panel 10 exposed to sunlight be treated to protect against ultraviolet-induced deterioration. Thus, for example, PVC tubes, connecting members and crossbars are preferably painted with an oil base paint.

Figure 4:
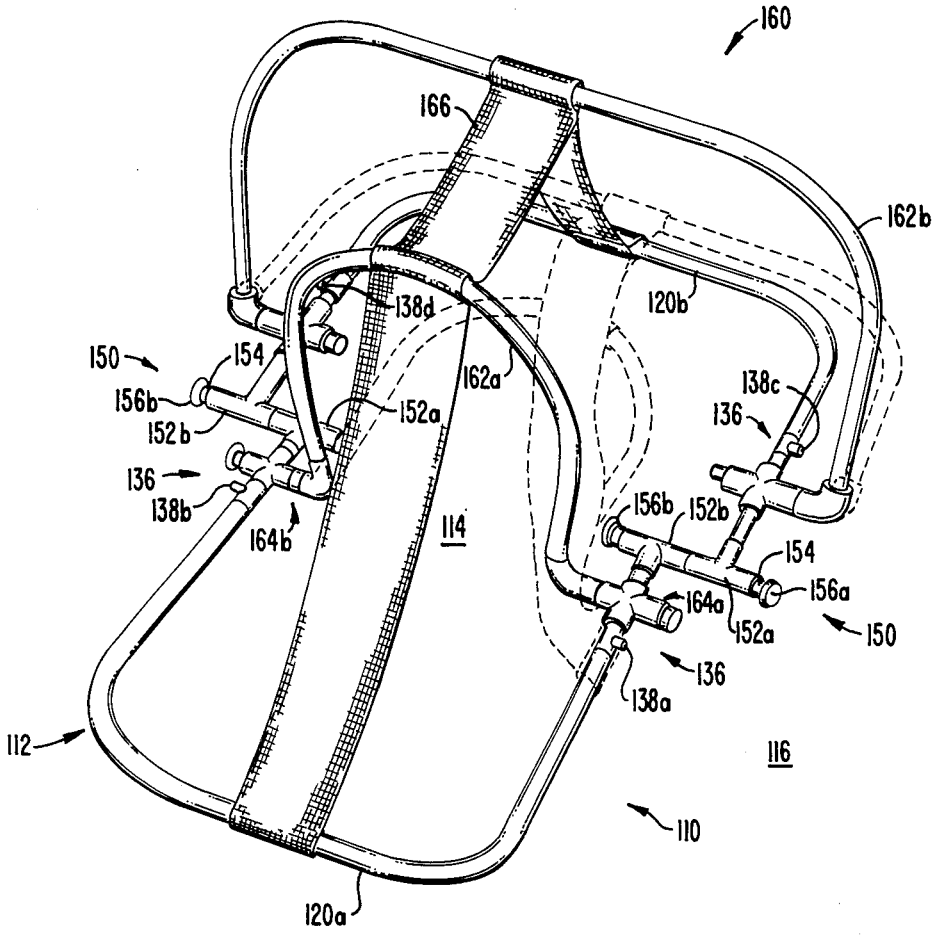
FIG. 4 is a perspective view of another embodiment of the invention.

For some building component applications, there may be no need to include bracing means 42. For example and with reference to FIG. 4, panel 110 illustrates another embodiment of the invention which may be used as the base for a temporary carport structure by being placed horizontally on the ground. Panel 110 comprises a peripheral structure 112 defining an internal region 114 and an external region 116 and has two hollow plastic extrusions 120*a* and 120*b*, each of which is generally U-shaped. Each hollow plastic extrusion 120*a* and 120*b* has solid extrusions (not illustrated) disposed within the straight portions of the hollow plastic extrusions 120*a* and 120*b*, while leaving sufficient space to permit a liquid to be interposed in the hollow plastic extrusions 120*a* and 120*b*. There are preferably three solid extrusions in each of the hollow plastic extrusions 120*a* and 120*b*. Means 136 for permitting a liquid to be interposed into the hollow plastic extrusions 120*a* and 120*b* is provided, such as fittings with passageways 138*a*, 138*b*, 138*c* and 138*d* leading into the interior of plastic extrusions 120*a* and 120*b*. As may be understood, one passageway of 138*a* and 138*b* will be closed by conventional means such as a plug or stopper (not illustrated) when introducing liquid to make the hollow plastic extrusion 120*a* more massive. An analogous procedure will be followed when introducing water into hollow plastic extrusion 120*b*.

Hollow plastic extrusions 120*a* and 120*b* of peripheral structure 112 are preferably pivotally connected by means 150 which may be formed by a pair of hollow "T" members 152*a* and 152*b* in which a cylindrical member 154 is rotatably disposed and held within T-members 152*a* and 152*b* by end caps 156*a* and 156*b*. Pivotally connecting means 150 permits hollow plastic extrusions 120*a* and 120*b* to be pivoted 90° into an adjacent, facing relationship for compact storage when panel 110 is not in use.

Panel, or carport, 110 includes means 160 for supporting a cover a spaced apart distance above interior 114. The cover (not illustrated) may be, for example, a tarpaulin or the like which may be lashed to peripheral structure 112. Supporting means 160 is adapted to support the cover and may comprise a pair of tubular arm members **162*a* and 162*b* positionable by pivotal connections 164*a* and 164*b* (analogous to pivotal connecting means 150) and held in an upright position by strap 166. Each arm member is thus pivotable into a raised or a flattened position in a manner similar to plastic extrusion member 120*a* and 120*b*** for convenient storage when the portable carport embodiment is not used and flattened.

Thus, panels of the invention are versatile building components, particularly suitable as a gate or as fence sections, but also appropriately utilized for applications such as a portable carport.

While the invention has been described in connection with specific embodiments thereof, it will be understood that it is capable of further modifications, and this application is intended to cover any variations, uses or adaptations of the invention following, in general, the principles of the invention and including such departures from the disclosure as come within the known or customary practice in the art to which the invention pertains and as may be applied to the essential features hereinbefore set forth, and as fall within the a scope of the invention and the limits of the appended claims.

We claim:

1. A panel comprising:

a peripheral structure defining an internal region and an external region and having at least one hollow plastic extrusion and at least one solid extrusion corresponding to the hollow plastic extrusion, the corresponding solid extrusion disposed within the hollow plastic extrusion while leaving sufficient space to permit a liquid to be interposed in the hollow plastic extrusion; and, means operatively associated with the hollow plastic extrusion for selectively permitting a liquid to be interposed into the hollow plastic extrusion adjacent the corresponding solid extrusion and selectively drained therefrom.

2. The panel as in claim 1 wherein the hollow plastic extrusions have a cross-sectional, internal dimension and the corresponding solid extrusions have a cross-sectional, external dimension, said external dimension being at least about ⅛" smaller than said internal dimension.

3. The panel as in claim 1 further comprising a plurality of crossbars, each crossbar extending across the internal region and attached to the peripheral structure.

4. The panel as in claim 3 wherein:

the peripheral structure forms a quadrilateral and has first and second pairs of opposed hollow plastic extrusions, each hollow plastic extrusion of one pair being connected by connecting means to both hollow plastic extrusions of the other pair, each hollow plastic extrusion of the first and second pairs having a corresponding solid extrusion therewithin, the connecting means permitting liquid communication between the spaces of the first and second pairs of opposed hollow plastic extrusions.

5. The panel as in claim 4 wherein the connecting means includes four L-shaped, hollow plastic members.

6. The panel as in claim 5 wherein the peripheral structure has transverse passageways interconnecting the spaces of the first and second pairs of hollow plastic extrusions and the external or internal region of the peripheral structure.

7. The panel as in claim 4 wherein the hollow plastic extrusions are polyvinyl chloride tubes and the solid extrusions are wooden rods.

8. The panel as in claim 7 wherein the wooden rods are impregnated with a water soluble or miscible compound having a freezing point below 0° C.

9. A gate or fence section comprising:

a rectangular structure defining a periphery and having a first pair of substantially parallel plastic tubes, a second pair of substantially parallel plastic tubes, four L-shaped hollow plastic members interconnecting the first and second pairs of tubes, and reinforcing rods disposed within the first and second pairs of tubes, the rods of sufficiently smaller size than the hollow plastic members as to leave a chamber interior to and extending around the periphery;

means operatively associated with the chamber for selectively interposing water into the chamber and selectively draining the water therefrom, and, means within the periphery for bracing the rectangular structure.

10. A portable carport frame comprising:

a base having a pair of opposed hollow plastic extrusions and a plurality of solid extrusions disposed within each of the opposed hollow plastic extrusions while leaving sufficient space to permit a liquid to be interposed in the hollow plastic extrusions;

means operatively associated with the hollow plastic extrusions for selectively permitting a liquid to be interposed into the hollow plastic extrusions; and, at least one arm member pivotally connected to the base and positionable into an upright position perpendicular with respect to the base.

* * * * *